US006642854B2

(12) United States Patent
McMaster

(10) Patent No.: US 6,642,854 B2
(45) Date of Patent: Nov. 4, 2003

(54) ELECTRONIC CAR PARK MANAGEMENT SYSTEM

(76) Inventor: Steven James McMaster, P.O. Box 3927, Burleigh Town, QLD (AU), 4220

( * ) Notice: Subject to any disclaimer, the term of this patent is extended or adjusted under 35 U.S.C. 154(b) by 0 days.

(21) Appl. No.: 09/855,914

(22) Filed: May 16, 2001

(65) Prior Publication Data

US 2001/0052860 A1 Dec. 20, 2001

(51) Int. Cl.[7] ..... G08G 1/14

(52) U.S. Cl. ..... 340/932.2; 340/426; 340/942; 250/578

(58) Field of Search ..... 340/932.2, 942, 340/555, 426; 250/200, 206, 578; 307/117

(56) References Cited

U.S. PATENT DOCUMENTS 3,376,547 A * 4/1968 Auer, Jr. ..... 340/51
4,575,638 A * 3/1986 Okumura ..... 250/578
4,996,515 A * 2/1991 Schaffer et al. ..... 340/426
5,004,997 A * 4/1991 Shisgal et al. ..... 340/436
5,432,508 A * 7/1995 Jackson ..... 340/932.2
5,572,074 A * 11/1996 Standley ..... 307/117
6,147,624 A * 11/2000 Clapper ..... 340/932.2

* cited by examiner

*Primary Examiner*—Daniel J. Wu
*Assistant Examiner*—Phung Nguyen

(57) ABSTRACT

An electronic system which facilitates active signs for car park management systems. There is a light sensitive sensor in each car space allowing a very simple circuit to distinguish whether a group of car spaces is full or has one or more vacant spaces available. There is not necessarily a need for a computer or even a microprocessor to ascertain the vacant or full state of a group of car spaces. This electronic system may directly switch devices accordingly.

6 Claims, 7 Drawing Sheets

ELECTRONIC CAR PARK MANAGEMENT SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

This invention is related to car parking areas sometimes referred to as car parks, parking lots or parking garages. Specifically in the area of car parking management the invention is aimed at providing information to motorists as to where there are vacant car spaces and which sections or aisles are full. This is usually by way of active signs which would indicate 'vacant' or 'full' while using arrows to denote the section or aisle being referred to.

The basic concept of using active signs in car parks whether in networks or otherwise to point out to motorists full or vacant areas is well established in various patent applications world wide. This general concept is not within the scope of this invention, though this invention through its application is meant to ultimately fulfill this goal.

Car park management systems of this sort can be generally grouped into two categories; firstly counting systems; and secondly systems using individual car space sensors linked to a central control.

This first type is the most simple and inexpensive though very limited in its application. It necessitates only one entrance and separate exit points to be monitored by sensors per counter. This means that it cannot be used to monitor a specific parking aisle which typically allows far too many separate entrance and exit points. It uses simple arithmetic to determine the occupancy state of the particular area and is subject to cumulative error from false detection of the sensors (e.g. from people or shopping trolleys etc.).

The second type tends to be more complex and expensive, the degree of which is directly proportion to the number of car spaces being monitored, but because it uses sensors in each car space its more flexible and it can be used to monitor any desired area of car spaces and any number of car spaces. This type of system is also significantly less affected by false detection as the information is not cumulative, typically resetting within a short time.

This invention uses the second concept while most particularly attempting to significantly reduce the cost and complexity involved in implementing it in areas from small to very large numbers of car spaces. Prior art concerning this type of system invariably involves using sensors capable of detecting vehicles within the car spaces in conjunction with a digital signaling system using a central processing point which polls each of these sensors periodically to ascertain the state of each space and hence the state of the area being monitored. See U.S. Pat. No. 5,432,508. In practice this involves having a sensor, microprocessor and supporting electronic circuitry within each car space. This arrangement also requires power as well as signaling buses running out into the car park.

The most cost effective type of sensor is a light sensor, infrared or visible light, whereby the vehicle blocks the source of this light causing a change in the sensors internal resistance. Prior art descriptions of this type of sensor are limited to using a discreet wavelength emitter mounted next to a light sensor sensitive to this wavelength in a unit mounted to the ceiling above the car space. A reflector is mounted on the floor of the car space. Again refer to U.S. Pat. No. 5,432,508. This is a well known and widely used arrangement in many fields. It is however probably too complex and expensive to put one of each of these components in every car space of which there may be 1000 or more. Also there is the unpredictable effects that sunlight, direct or reflected, has on this type of sensor. This is a well known problem concerning remote infrared signaling, therefore limiting this type of sensor to fully undercover areas. This in practice is particularly limiting as even most under cover car parks have open walls allowing sunlight to augment the artificial lighting.

This invention facilitates use in environments exposed to full sunlight, part sunlight/part artificial light and all artificial light. It does not need polling technology, microprocessors or computers. It uses in general one single visible light sensor component for each car space, connected together in very simple fashion. Every group of two to say ten car spaces may require an ambient light sensor that compensates for changing ambient conditions. Again the ambient light sensors are very simple (a light sensor and one transistor) connected in very simple fashion. In practice it uses three conductors and is laid into a shallow cut in the surface of the concrete in quick and simple fashion.

This invention was developed especially to allow ease of installation as well as accurate detection of the state of the car park. The first commercial and fully functioning system was installed in Southport, Australia in a shopping centre car park in March, 2001. It uses only those components defined in this specification.

BRIEF SUMMARY OF THE INVENTION

The object of the invention is to facilitate car park occupancy active signage systems (car park management systems) in a cost effective and relatively simple fashion. These types of systems by way of changeable or active signs indicate to motorists within car parking areas which sections or aisles have vacant parking spaces and which are fully occupied.

The invention facilitates this objective by placing one or two sensors in the middle of each of the relevant monitored car spaces which indicates whether a vehicle occupies the car space or not. These sensors are discreet light sensitive transistors or diodes which in practice detect the shadows of vehicles.

Other proposed systems require much more complex hardware and higher cost sensor arrangements which must be duplicated for each and every car space monitored.

With simple and inexpensive circuitry this invention is able to indicate whether a group of car spaces has one or more vacant spaces or is completely full. It performs this function without digital address buses, digital multiplexing, microprocessors, computers or periodic polling of the individual sensors.

This drawing is a schematic of the electronic system used in this invention which consists of a parallel array of light sensors (2) made up of a number light sensitive semiconductor components (1), whereby the resistance between the top and bottom rails of the array, (3) and (4) respectively are monitored by an electronic detection means (5) which incorporates a capability for switching (6) to control other devices.

FIG. 2.

Figure 1:
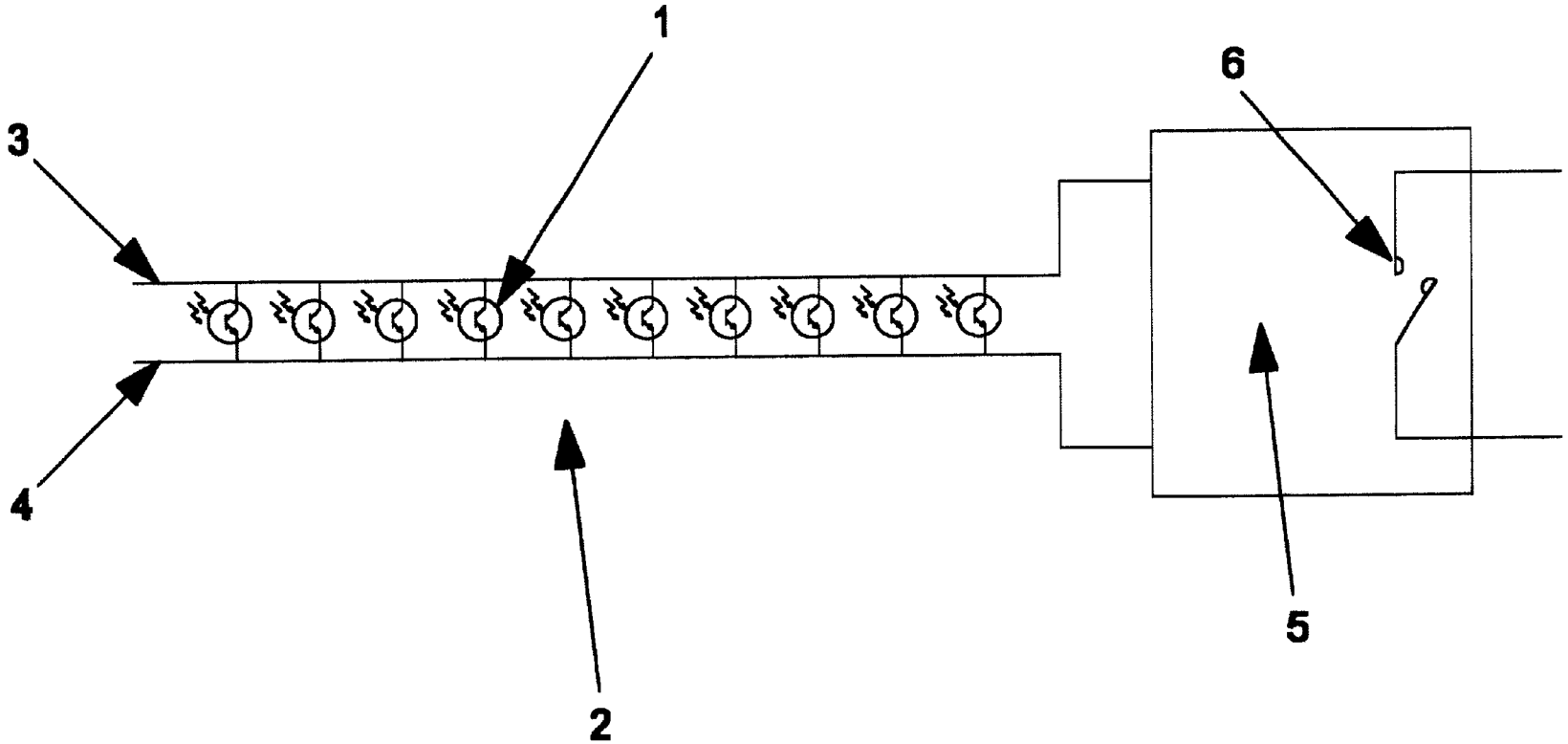
FIG. 1.

This drawing is similar to FIG. 1., with the following additions. The parallel array of light sensors (1) connects to a transistor (2). The transistor forming part of the electronic detection means (3). An ambient light sensor (4) connects between the base and emitter of the transistor in order to compensate for varying ambient light conditions.

FIG. 3.

Figure 2:
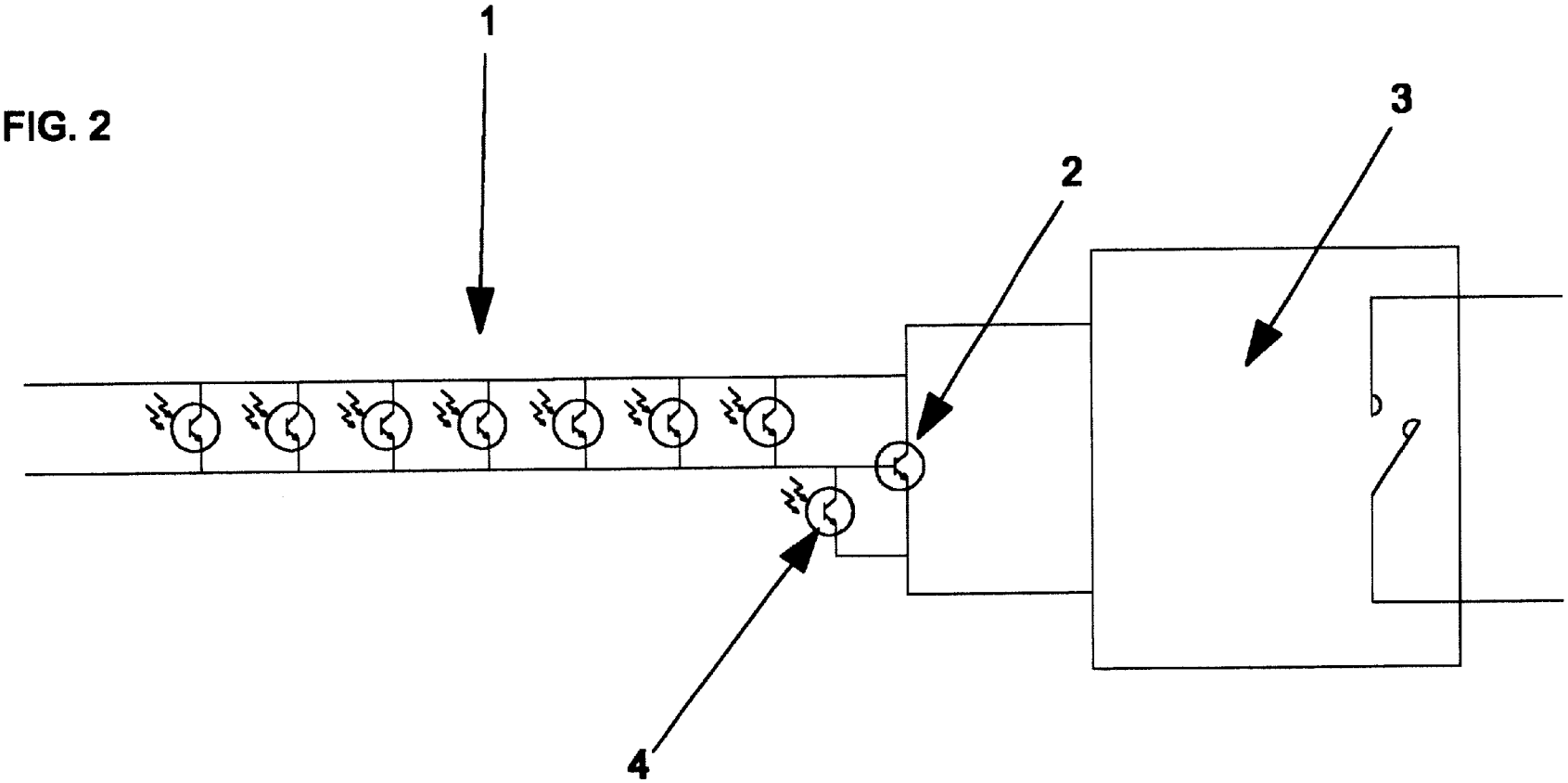
Figure 3:
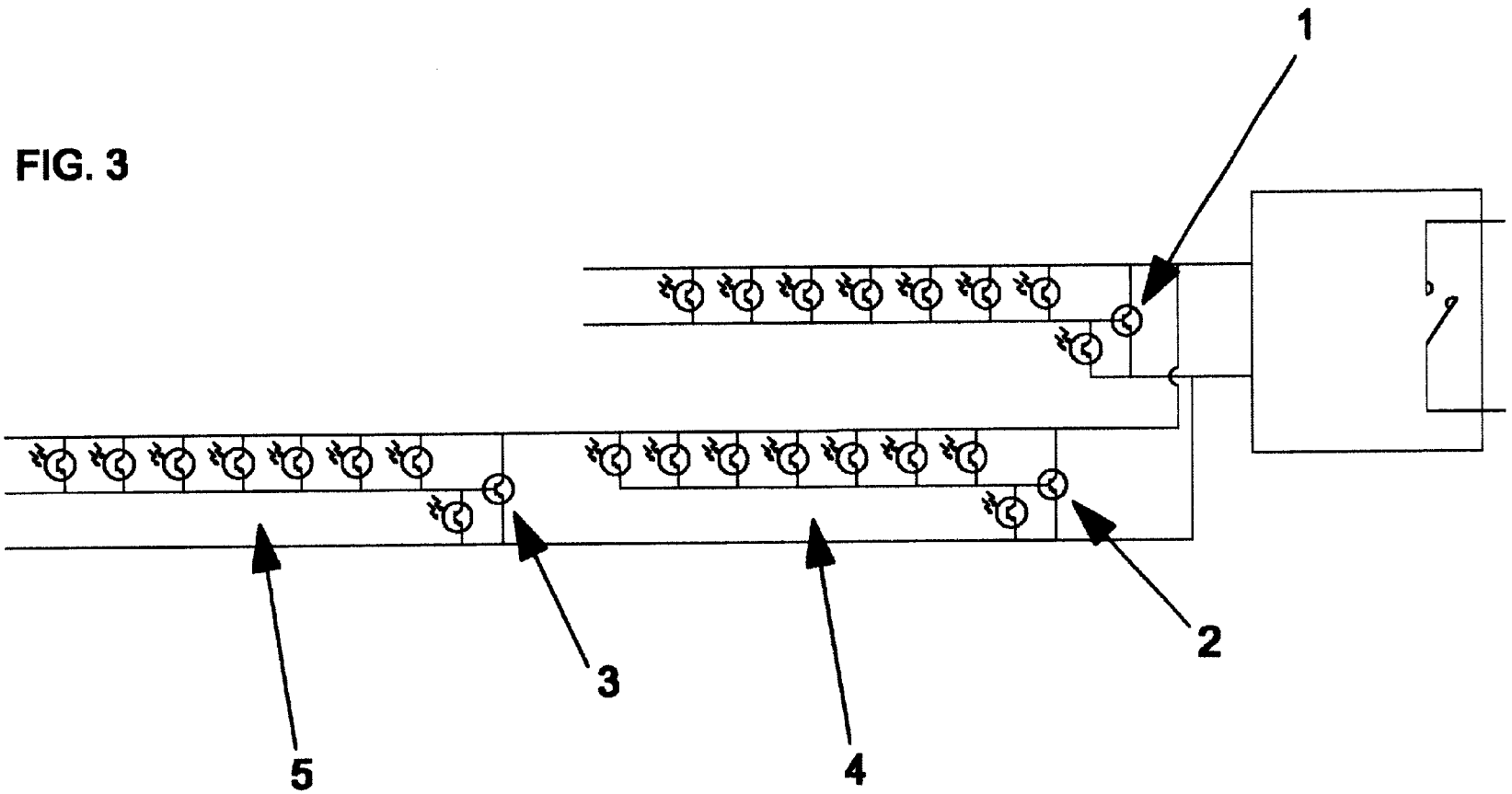

This drawing is similar to FIG. 2., with the following additions. Further parallel arrays of light sensors (4) and (5) may be connected in parallel with the transistor (1) of the original parallel array of light sensors. The transistors (1), (2) and (3) have their collectors connected together and their emitters connected together.

FIG. 4.

This drawing is similar to FIG. 1., with the following alterations. The electronic detection means consists of an electric transducer (2) connected in parallel with a transistor (1). The top and bottom rails (5) of the parallel array of light sensors are connected to the collector and base of the transistor. There is further means (3) for detecting the output (4) of the transducer (2). Voltage (6) is connected to the circuit via a limiting resistor (7).

FIG. 5.

Figure 4:
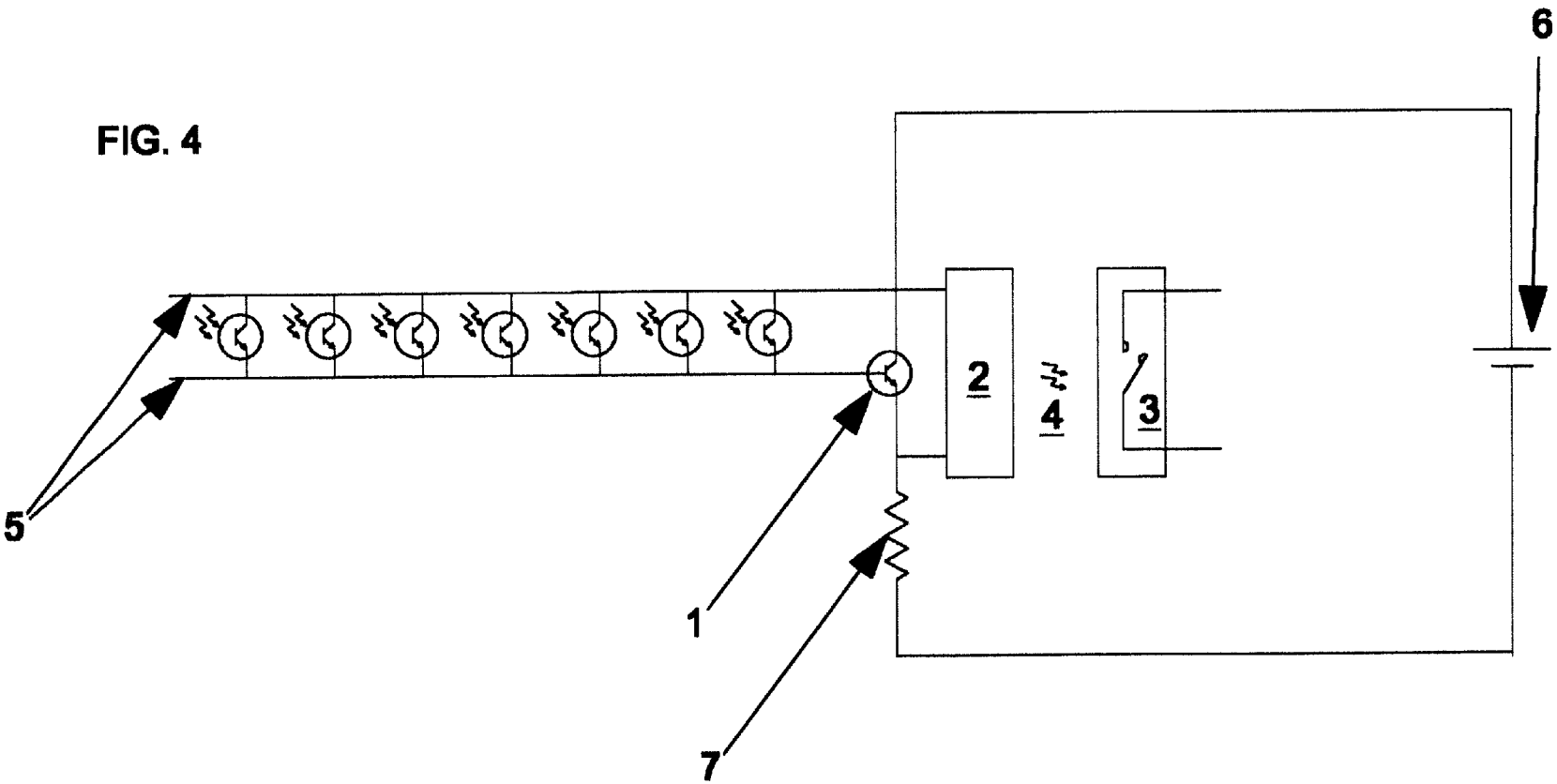
Figure 5:
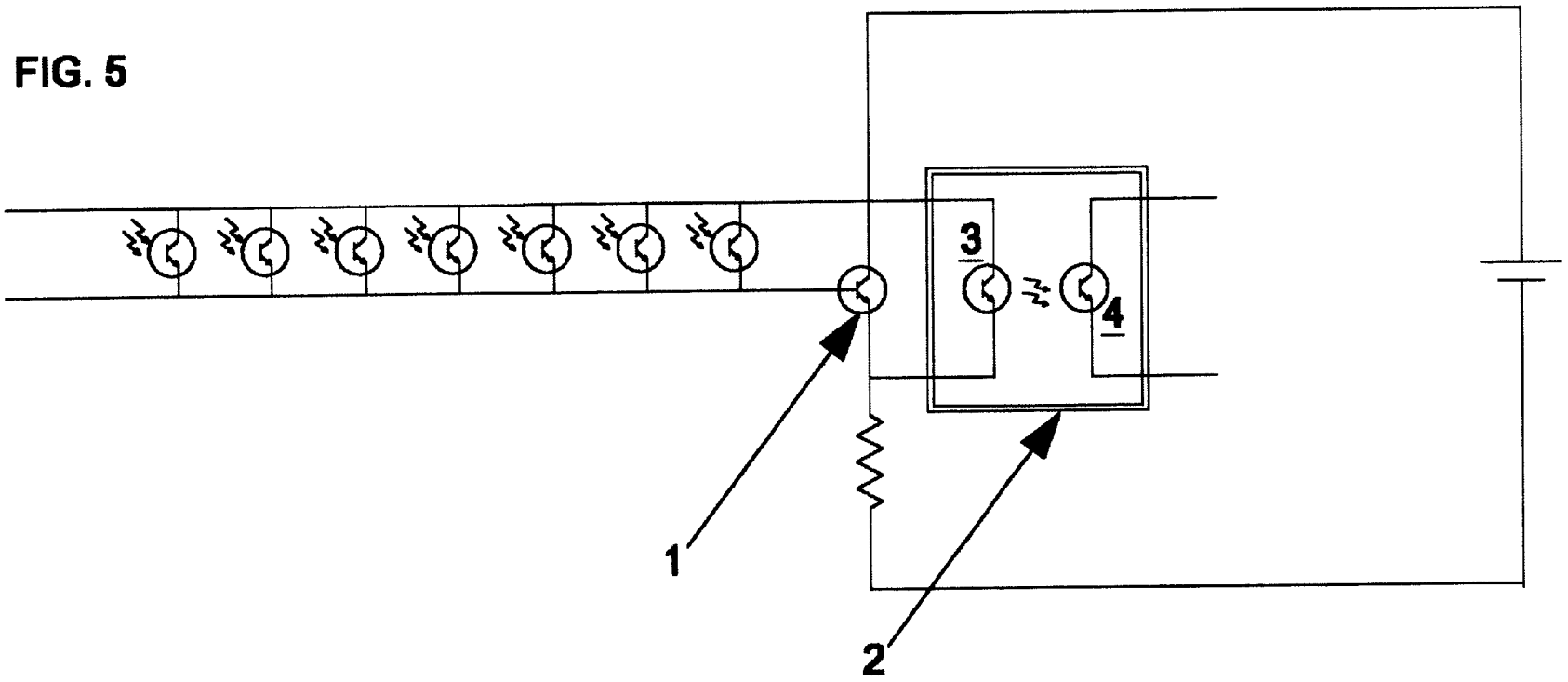
Figure 6:
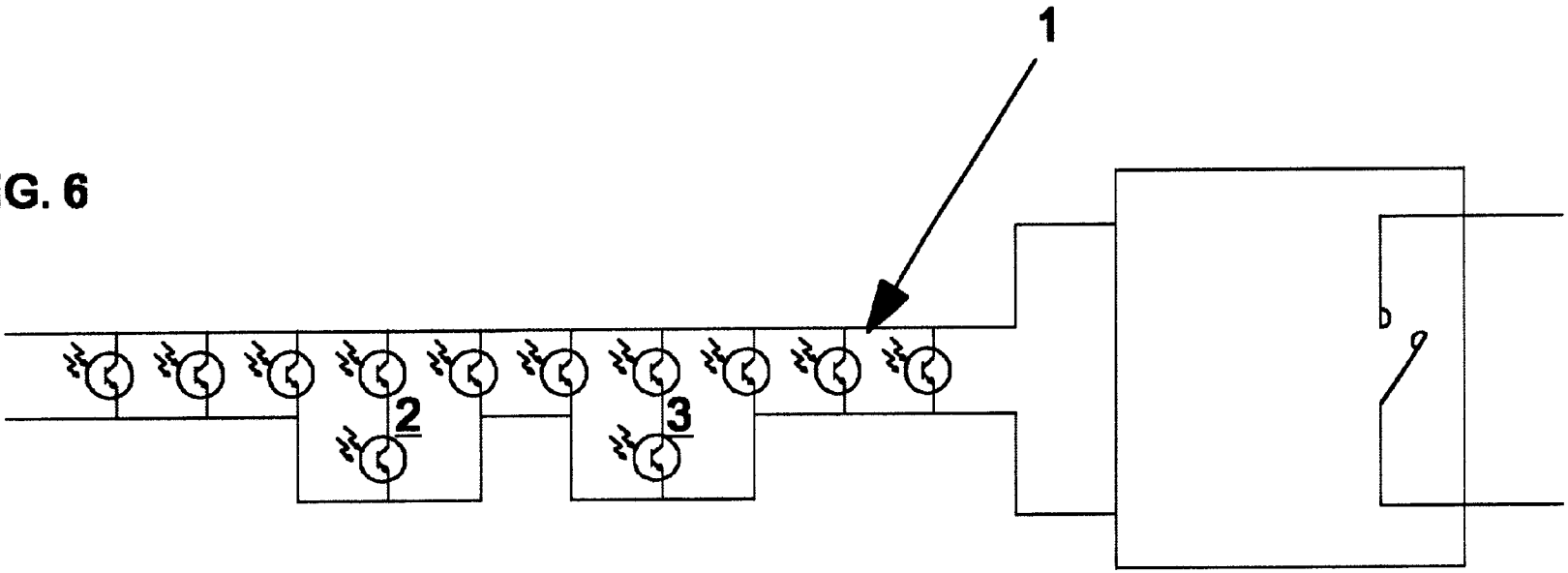
Figure 7:
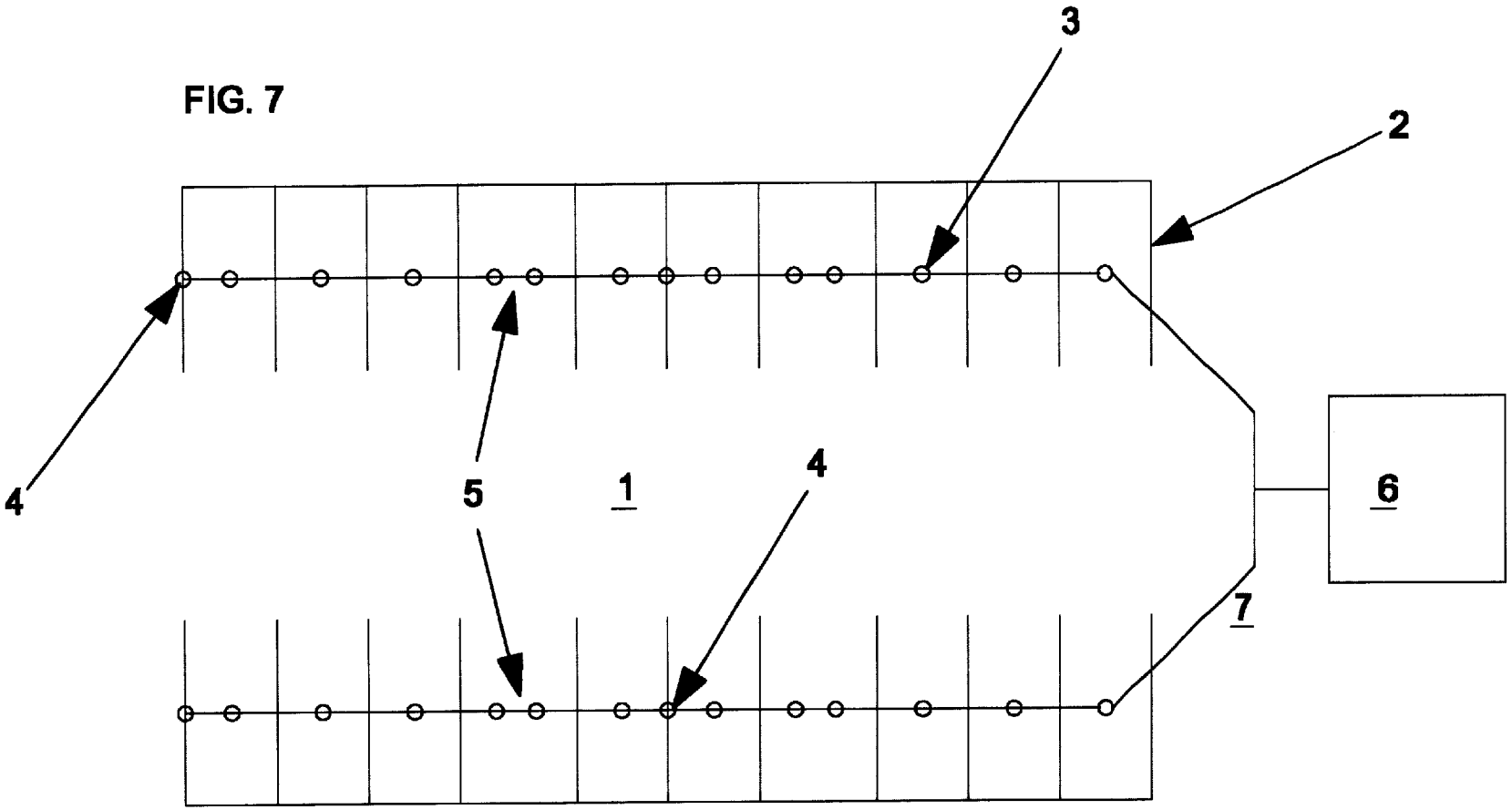

This drawing is similar to FIG. 4., with the following substitutions. The electronic detection means is an optocoupler (2) whereby the transducer is an LED (3) with its output monitored by a light sensitive component (4). The LED is connected in parallel with the transistor (1).

FIG. 6.

This drawing is similar to FIG. 1., with the following alterations. Some of the light sensors (2) and (3) of a parallel array of light sensors (1) have additional light sensors connected in series. These sets of series connected light sensors (2) and (3) are designed for wide car spaces. Both components of either (2) or (3) physically mount in the same car space.

FIG. 7.

This drawing depicts an aerial view of a typical parking aisle (1) with lines (2) defining various car spaces and typical arrangement of components of this invention. There is at least one light sensor (3) mounted in the middle of the floor of each monitored car space. There are a number of ambient light sensors (4) mounted outside or on the periphery of the car spaces. For wide car spaces, sets of series connected light sensors (5) are used. There is an electronic detection means (6) which is connected to the parallel arrays by cables (7).

DETAILED DESCRIPTION OF THE INVENTION

The ultimate objective of the invention is to facilitate inexpensive and effective means for controlling the indicator elements or active signs in car park management systems (and is hereon referred to as the objective or the stated objective). By the term 'car park management systems' is meant systems that are capable of informing motorists within car parking facilities which sections or areas or aisles are full and which have vacant parking places available. This would normally be achieved by way of strategically positioned signs at car park entrances or the ends of parking aisles. These signs would be active in that their display changes in relation to the availability conditions in the nominated parking areas.

This invention consists of an electronic circuit with specific components of the circuit being physically located in specific positions within the car park. It uses a sensor in each car space being monitored. This invention is sufficient to fulfill the above objective in the most simple and inexpensive manor known to the inventor. Other advantages over current or conventional technology are; ease of installation, low maintenance and low cost of maintenance. The simplicity is an important factor due to the fact that, usually, numbers of parking spaces run into hundreds and thousands within typical car parking lots, necessitating that what components and labor are needed for each car space are multiplied by hundreds or thousands for a complete car park management system.

This invention is capable of monitoring a group of car parking spaces and is able to determine two states of that group. The two states are; that either the group is completely full or occupied, or, that there is one or more vacant spaces available within the group. Conventional car park management systems utilising individual car space sensors, use sensors which must be directly polled periodically, each polling operation using a computer or microprocessor giving the result of only one car space at a time via a digital address bus. There must also be a micro-processor or similar attached to each sensor to code and decode data to and from the address bus, necessitating multiple components for each car space. This is not the case with this invention as it can monitor a group (or groups) of car spaces without these complex digital components.

As mentioned this invention uses a sensor in each car space. Conventional technologies that are capable of discreetly and non intrusively determining the existence or the absence of vehicles within parking spaces are; metal detecting devices, infrared sender/receivers and sonic or radio range finders (sonar and radar). These devices all require multiple components for each sensor.

The sensors used by this invention are light sensitive electronic components only and more specifically only those that use semiconductor technology such as phototransistors or photodiodes (hereon referred to as light sensors). There is at least one of these light sensors mounted on, or flush with, the floor of each car space to be monitored; generally toward the middle or central point of the car space bounds. Simply, when a vehicle is parked within the car space, it reduces the ambient light falling incident upon the light sensor which changes the internal resistance of that light sensor (the vehicle casts its shadow over the light sensor). This internal resistance is used to determine the occupancy state of the car space.

The reason for using semiconductor light sensors is due to the way these components behave when multiples of them are connected electrically in parallel (as against series) configuration. The resistance between the top and bottom rails of such a parallel circuit remains reasonably stable with increasing numbers of parallel components and reduces nothing like the extent that it would with resistors connected in the same way. Resistors in parallel (r1,r2,r3 . . . ) obey the known formula 1/r1+1/r2+1/r3+ . . . =1/R where R is the resistance between the top and bottom rails, while semiconductors do not strictly obey this law. It can be seen that with increasing numbers of parallel resistors, the resistance drops away significantly, therefore light dependent resistors are unsuitable for this invention.

The behavior of the semiconductor light sensors enables a multiple of them to be connected in parallel without changing the effectiveness of the individual sensors. If all the light sensors are blocked by vehicles, they all will have relatively high internal resistance and hence the parallel array as a whole will also have relatively high resistance (as measured between the top and bottom rails); while if one or more light sensors are fully exposed to ambient light, the resistance of the parallel array is substantially reduced. This means that a string of these parallel light sensors on a two wire cable can be laid out within a group of car spaces (in such fashion as previously described) requiring only examination of the top and bottom rail resistance (between one wire and the other) in order to determine the occupancy of the whole group.

This arrangement when combined with an electronic detection means for detecting and indicating the resistive state of the parallel array of light sensors gives a system capable of achieving the stated objective—in situations with constant or at least reasonably stable ambient light conditions. The most simple and yet effective way of achieving this electronic detection means uses a transistor and opto-coupler. (An opto-coupler consists of a light emitting diode or LED which casts its light directly onto a phototransistor or photodiode within a sealed encapsulation). The LED is connected in parallel with the transistor between the collector and emitter. The parallel array of light sensors connects to the collector and base of the transistor turning it on or off. When the transistor is on, it shorts and turns off the LED hence turning off the opto-coupler output. The circuit is connected to voltage via a limiting resistor. In practice this works very well as the opto-coupler isolates the parallel array of light sensors from the switching circuitry. It may be desirable to put the opto-coupler in series with the transistor. A convention relay may also suffice as the electronic detection means being connected in parallel or in series with the transistor.

In order to overcome variables such as changing ambient light conditions, the following enhancements are also included in the scope of this invention. There may be the addition of ambient light compensating circuitry for each group of car spaces monitored. In most fundamental form this ambient light compensating circuitry consists of two components; a light sensor, combined with a transistor such that the light sensor connects to the base and emitter of the transistor in correct polarity (this particular light sensor will hereon be referred to as an 'ambient light sensor'). The two rails of the parallel array of light sensors connect to the collector and base terminals of the transistor (in correct polarity) controlling it by switching it on or off. The ambient light sensor in effect conducts current away from the base/emitter junction of the transistor at a rate that is directly proportional to the level of ambient light incident upon it. The transistor in this case will form part of the electronic detection means. This transistor will correspond to the transistor as described above when using an opto-coupler as part of the electronic detection means. In practice this is a very effective method for compensating for very large changes in ambient light, from faint artificial light at night, to full sunlight.

The ambient light sensors should be physically located so as to receive representative or similar ambient light conditions as the parallel array of light sensors that it compensates for. The representative ambient light conditions referred to must change generally in proportion to the ambient light conditions of the light sensors. This will generally be physically close to the light sensors on or near the periphery of the car spaces mounted on the floor, walls columns or ceiling. The ambient light sensor should not be mounted where a significant reduction in its incident ambient light occurs due to the presence of any cars parked within the monitored car spaces.

In order that each group of monitored car spaces may have its own ambient light sensor which more closely compensates for the particular ambient light conditions of each group, the following alternative arrangement is included in the scope of this invention. Further separate parallel arrays of light sensors, each with its own ambient light sensor and transistor, may be connected in parallel (as follows) with the existing parallel array, ambient light sensor and transistor. The parallel connections of these sections will be such that, of the transistors, the collectors are connected together and the emitters are connected together. This arrangement may also be used in conjunction with an opto-coupler as previously described with the LED in parallel to these parallel transistors. The physical location of all of these ambient light sensors should be such that each ambient light sensor receives a level of ambient light similar to the particular parallel array of light sensors that it compensates for.

One or more parallel arrays of light sensors connected to each other in parallel which might have associated ambient light sensors and connect to an electronic detection means will hereon be referred to as a 'basic unit' of a car park management system. There may be one or more of these basic units controlling one indicator element (perhaps an active sign). This indicator element will be able to directly control other indicator elements by; either overriding these other indicator elements directly via cable; or by putting a short circuit (via cable) on any parallel array of light sensors that is part of a basic unit switching the particular indicator element. This second method will mimic a vacant car space in the particular basic unit causing its electronic detection means switch to a vacant condition from a full condition. Indicator elements may also indirectly control other indicator elements via a computer or micro processor.

In practice this invention may involve cutting shallow grooves in the surface of the car park and laying the cables with the described components attached into this groove. Ambient light sensors may be attached adjacent to the associated transistors and, as a unit, placed within the car park between the car spaces, mounted on the floor or otherwise. Two and three wire cables are generally sufficient to connect the various components back to the main part of the electronic detection means. A durable filler medium may be applied to cover the cables, fill the grooves and set in the light sensors to prevent damage.

The specific arrangements documented in this specification, with regard to this invention, demonstrate the most fundamental or basic arrangements that will enable it to facilitate its stated objective, though do not limit the scope the invention which has been defined by the claims herein. It must be understood that these basic arrangements may be somewhat elaborated upon to achieve specific or general improvements, as seen fit, while still remaining within the scope of this invention. These basic arrangements, improved or otherwise, may also be used in conjunction with other contemporary electronic equipment in order to facilitate the stated objective, enhanced or otherwise, while also remaining within the scope of this invention.

I claim as my invention:

1. An electronic system for monitoring the occupancy state of a group of car parking spaces, to ascertain only two states of that group; either that it is completely full or that there is one or more vacant spaces, comprising;

an array of light sensors; which are electronic semiconductor components each with positive and negative leads; all electrically connected together in parallel sequence with all the positive leads connected to one signal wire and all the negative leads connected to another signal wire forming top and bottom parallel rails; with the top and bottom parallel rails connected to the collector and base respectively of a transistor;

with each of these light sensors physically located within the bounds of a separate car space such that there is at least one light sensor in each monitored car space in the group;

and that the light sensors are located on the floor of each of the car spaces positioned under any motor vehicles parked within the relevant car spaces;

and further comprising a single electronic detection means for determining the state of the array of light sensors via the transistor collector and emitter leads; to indicate the full or vacant state of the group of car spaces, wherein the state of all light sensors in that group are monitored by the singular detection means simultaneously; and the voltage requirement for the light sensors is supplied via the collector and emitter of the transistor;

wherein said detection means has the capability to switch other devices accordingly.

2. An electronic system as defined in claim 1, wherein; the top and bottom rails of the parallel array of light sensors connect to the collector and base terminals of the transistor; and a light sensor, is connected between the base and emitter of the transistor in correct polarity for the purpose of automatically adjusting to ambient light conditions; this ambient light sensor being physically located to be exposed to ambient light conditions representative of the parallel array of light sensors that it compensates for.

3. An electronic system as defined in claim 2, wherein;

the parallel array of light sensors with its transistor and ambient light sensor is connected in parallel with a number of other parallel arrays of light sensors, each with its own transistor and ambient light sensor whereby the collectors of the transistors are connected together and the emitters of the transistors are connected together; for the purpose that each array of light sensors has its own independent ambient light sensor.

4. An electronic system as defined in claim 1, wherein;

any or all of the parallel light sensors within a parallel array of light sensors may have additional light sensors connected in series in order to bridge from the top to bottom rail of the parallel array;

whereby these sets of series connected light sensors are still connected into the parallel array of light sensors in parallel with other light sensor components, for the purpose of wide or long car spaces with a set of series connected light sensors distributed as desired within the one car space for greater coverage.

5. An electronic system as defined in claim 1, which:

incorporates circuitry to adjust the sensitivity of the light sensor array to suit ambient light conditions which consists of a resistive component connected between the base and emitter leads of the transistor for the purpose of automatically adjusting to ambient light conditions; the resistor being fixed in resistance or variable to fine tune adjustment.

6. An electronic system as defined in claim 1, wherein;

the light sensors, each having collector and emitter leads; all electrically connected together in parallel sequence with all the collector leads connected to one signal wire and all the emitter leads connected to another signal wire forming top and bottom parallel rails;

the singular electronic detection means determining the state of array of light sensors via the top and bottom parallel rails, omitting the transistor; to indicate the full or vacant state of the group of car spaces, wherein the state of all light sensors in that group are monitored by the singular detection means simultaneously; and the voltage requirement for the light sensors is supplied via the top and bottom parallel rails.

* * * * *